US010935024B2

(12) United States Patent
Buckley

(10) Patent No.: US 10,935,024 B2
(45) Date of Patent: Mar. 2, 2021

(54) SEALING SYSTEM PUMP PISTON

(71) Applicant: ST9 Gas and Oil, LLC, The Woodlands, TX (US)

(72) Inventor: Chris Buckley, Tomball, TX (US)

(73) Assignee: ST9 Gas and Oil, LLC, The Woodlands, TX (US)

( * ) Notice: Subject to any disclaimer, the term of this patent is extended or adjusted under 35 U.S.C. 154(b) by 0 days.

(21) Appl. No.: 16/803,141

(22) Filed: Feb. 27, 2020

(65) Prior Publication Data

US 2020/0191141 A1 Jun. 18, 2020

Related U.S. Application Data

(63) Continuation of application No. 15/998,633, filed on Aug. 15, 2018, now Pat. No. 10,590,927.

(60) Provisional application No. 62/545,854, filed on Aug. 15, 2017.

(51) Int. Cl.

| | |
|---|---|
| ***F04B 53/14*** | (2006.01) |
| ***F04B 53/16*** | (2006.01) |
| ***F04B 19/22*** | (2006.01) |
| ***F04B 53/18*** | (2006.01) |
| *E21B 43/267* | (2006.01) |

(52) U.S. Cl.

CPC ..... *F04B 53/143* (2013.01); *F04B 19/22* (2013.01); *F04B 53/164* (2013.01); *F04B 53/18* (2013.01); *E21B 43/267* (2013.01)

(58) Field of Classification Search

CPC . F16J 1/08; F04B 53/164; F04B 53/18; F04B 53/14; F04B 53/143

USPC ..... 92/182

See application file for complete search history.

(56) References Cited

U.S. PATENT DOCUMENTS

| | | | | |
|---|---|---|---|---|
| 2,486,939 | A | 11/1949 | Freund | |
| 4,878,815 | A | 11/1989 | Stachowiak | |
| 5,493,951 | A | 2/1996 | Harrison | |
| 2007/0273105 | A1* | 11/2007 | Stanton | F16J 15/18 277/500 |
| 2015/0101679 | A1* | 4/2015 | Forrest | F16K 43/00 137/237 |

* cited by examiner

*Primary Examiner* — F Daniel Lopez
*Assistant Examiner* — Daniel S Collins

(57) ABSTRACT

A lubricating sealing system for a fluid end includes a fluid end, a sleeve, a plunger, and a lubrication system. The sleeve is coupled to an internal surface of the fluid end. The plunger reciprocates in a linear manner through the sleeve and into a pressure chamber of the fluid end. The lubrication system is in communication with the plunger and configured to provide lubricant through an interior of the plunger for routing to surfaces between the plunger and the sleeve. The lubricant is pressurized and moved via the reciprocating of the plunger and create a positive pressure on the lubricant over the pressures experienced in the pressure chamber of the fluid end. The positive pressure creates a barrier and pushes away contaminants from the plunger seals thereby avoiding wash out.

22 Claims, 5 Drawing Sheets

SEALING SYSTEM PUMP PISTON

CROSS REFERENCE TO RELATED APPLICATIONS

This application is a Continuation of U.S. patent application Ser. No. 15/998,633, entitled "Sealing System Pump Piston," filed Aug. 15, 2018, which claims the benefit of U.S. Provisional Application No. 62/545,854, filed 15 Aug. 2017. The benefit of each of these applications is claimed and the disclosure of each of these applications is hereby incorporated by reference in its entirety.

BACKGROUND

1. Field of the Invention

The present application relates generally to a reciprocating pump, and in particular to a lubricating sealing system for a plunger piston in the reciprocating pump.

2. Description of Related Art

Properly maintaining fluid ends in high-cycle environments is not easy, since packing bores can wash out at any time. If a packing or grease system fails, the packing bore gets cut by the high-pressure water, causing it to lose its ability to seal. The use of stainless steel fluid ends achieves higher cycle hours, but with those longer hours of operation, the packing begins to wear into the packing bore, creating waves. This is called washboarding.

Eventually, the packing bore becomes so severely washboarded that the packing will not seal. Washouts and washboarding can be weld repaired, but that drastically reduces the strength of the fluid end because welded material cannot compare to the strength of forged stainless steel. Weld repairs lower the endurance limit of the fluid end at the surface. Cracks in stainless fluid ends are found more frequently in welded areas than in non-welded areas.

The best solution for packing bore problems was invented many years ago when reciprocating pump companies began using removable stuffing boxes or stuffing box sleeves in their pumps. Stuffing box packing was widely adopted at the beginning of the $19^{th}$ Century with the development of reciprocating steam engines, and little changes to the design have been made since. Most changes since have focused on material construction with elements such as elastomers, fabrics, and engineered polymers. Stuffing boxes house the packing that goes into the fluid end, becoming a sacrificial piece.

Three fundamental flaws with conventional stuffing box packing remain: 1) Manual adjustment by a nut or other means to give the correct amount of sealing force is subjective whether at first fit or once worn; 2) The lubrication of the packing and the fastidious maintenance of the boundary layer fluid film between the seal and reciprocated parts are critical if meaningful life is to be achieved; and 3) The introduction and contact of the proppant with the sealing components often creates complications.

Although great strides have been made with respect to plugs and nuts in fluid ends, considerable shortcomings remain. An improved sealing assembly is needed to mitigate damage from the contaminants in the fracture fluid.

SUMMARY OF THE INVENTION

It is an object of the present application to provide a lubricating sealing system within a plunger piston of a reciprocating pump. The plunger reciprocates within a fluid end and is used to pump fluid/proppant from a suction valve to a discharge valve with each reciprocating motion. The lubricating sealing system is configured to apply a quantity of pressurized lubrication outward from the plunger directly to a gap between the plunger and a sleeve. As the plunger reciprocates against the sleeve in the fluid end, the pressurized lubrication is passed over the seals and acts as a barrier to the introduction of proppant and contaminants into the seal vicinity, thereby avoiding wash out.

It is a further object of the present application that the lubrication be introduced into a central passage within the plunger through a non-return valve in the plunger. Pressure is created within the lubrication passages of the plunger from the movement of the plunger itself. An intensification valve is located at a base of the plunger and translates within a channel as the plunger reciprocates. Movement of the intensification valve induces movement of the lubrication from the central passage outward through a plurality of outlet tubes where it fills the gap between the plunger and the sleeve.

A further object of the present application is to use an accumulator in fluid communication with the gap and the lubrication fluid. The accumulator includes a bladder to regulate pressure in the system so as to prevent pressures from exceeding the limits of the upper seals. The accumulator includes a solenoid valve to restrict outward flow from the accumulator to the gap.

Ultimately the invention may take many embodiments but features the ability to insert lubrication fluid directly between the sleeve and the plunger piston in a pressurized manner in order to effectively act as a barrier to proppant introduction at the seals. In this way, this assembly overcomes the disadvantages inherent in the prior art.

The more important features of the assembly have thus been outlined in order that the more detailed description that follows may be better understood and to ensure that the present contribution to the art is appreciated. Additional features of the system will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the system in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present system.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
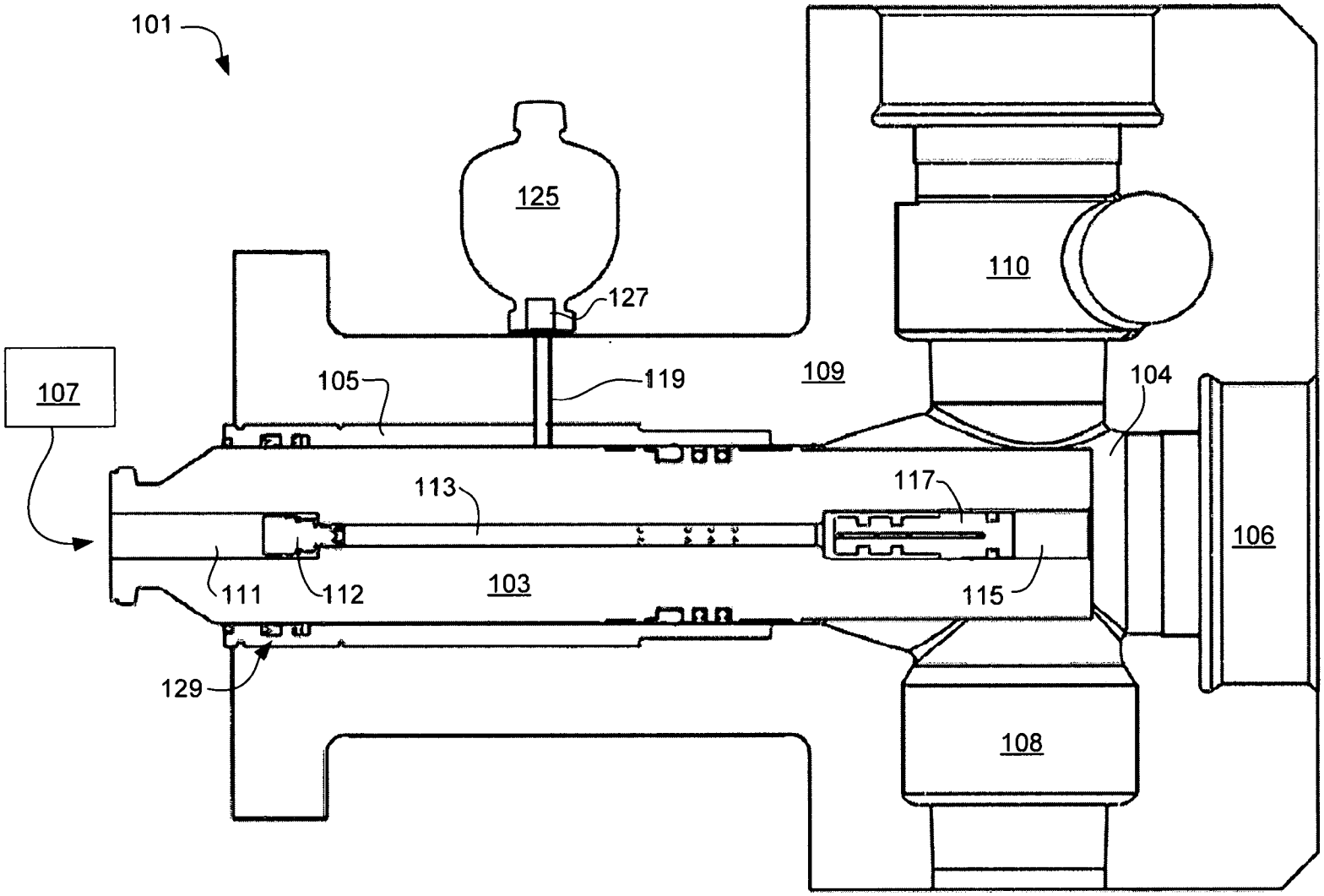
FIG. 1 is a section view of a lubricating sealing system pump piston according to an embodiment of the present application.

While the invention of the application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with conventional fluid end systems and stuffing boxes in conjunction with a plunger. The system is configured to introduce a lubricating fluid through a piston plunger to lubricate between the piston plunger and the sleeve. The lubrication fluid is pressurized and passes over the lower seals and forms a barrier to proppants in the fluid end pressure chamber. The lubricating system is configured to automatically pressurize and depressurize as the plunger piston reciprocates in the fluid end. Manual adjustment of nuts are not required. An effective boundary layer/barrier is formed to prevent wash out. These and other unique features of the device are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The lubricating sealing system pump piston of the present application includes a sleeve, a piston, a lubrication system, and a number of valves, bearings and/or seals sufficient to regulate lubrication and wear of the piston and sleeve during operation. In way of overview, the plunger bore sleeve is assembled into the pump housing/Fluid End. The assembled piston plunger is inserted into the sleeve, and connected to the lubrication/fluid barrier system. As the piston reciprocates in operation within the sleeve, the lubrication/fluid barrier is configured to inject an amount of fluid/lubrication into the piston plunger and subsequently outward through a plurality of routes to a lubrication cavity (i.e. gap between the piston plunger and the sleeve). This is done at a rate and frequency sufficient to maintain lubrication of the piston seal or piston ring and ensure the continuous fluid barrier. Excess pressurized lubrication fluid exits the fluid end into an accumulator. However, should failure occur, the damage (washout) will be confined to the sleeve and plunger piston not the housing/fluid end. Additional features and functions of the device are illustrated and discussed below.

Referring now to the Figures wherein like reference characters identify corresponding or similar elements in form and function throughout the several views. The following Figures describe the assembly of the present application and its associated features. With reference now to the Figures, an embodiment of the modular observation assembly and method of use are herein described. It should be noted that the articles "a", "an", and "the", as used in this specification, include plural referents unless the content clearly dictates otherwise.

Referring now to FIG. 1 in the drawings, a side section view of a lubricating sealing system pump piston according to the present application are illustrated. Sealing system pump piston 101 includes a plunger piston 103, a bore sleeve 105, and a lubrication system 107. Sleeve 105 extends at least partially between plunger 103 and fluid end 109. Lubrication system 107 is configured to provide lubricant that is passed through a portion of plunger 103 and directed into a gap between sleeve 105 and plunger 103 for the purpose of creating a barrier to the introduction of proppant at the seals.

Plunger 103 reciprocates within fluid end 109. Fluid end 109 includes a suction valve 108 and a discharge valve 110. The fluid end 109 defines a pressure chamber 104 that exists as the internal volume within the fluid end between a nut 106, valves 108 and 110, and plunger 103 at its furthest withdrawn point in its reciprocation movement. The pressure chamber is filled with proppant or working fluid that includes abrasive particulates that can be damaging to the seals, plunger 103, fluid end 109, and sleeve 105. The reciprocating movement of plunger 103 repeatedly moves plunger 103 into and out of pressure chamber 104.

Plunger 103 includes one or more passages and cavities that are used to permit the passage and dissemination of lubricant. Plunger 103 includes an upper channel 111, a central passage 113, and a lower channel 115. Upper channel 111, central passage 113, and lower channel 115 are in fluid communication with one another and generally extend the length of plunger 103. Lubricant is introduced into plunger 103 via upper channel 111. The lubricant is provided through lubrication system 107. Within upper channel 111, a valve 112 is located adjacent the transition into the central passage 113. Valve 112 is configured to regulate the passage of lubricant into central passage 113. Valve 112 may be a check valve, a relief valve, and/or a thermal valve. Valve 112 selectively permits that passage of lubricant from the lower pressure area of upper channel 111 into the pressurized area of central passage 113. An intensification valve 117 translates from end to end within lower channel 115 as plunger 103 reciprocates. Movement of valve 117 automatically induces the pressurization of lubricant in central passage 113 such that the lubricant passes through outlet tubes 116. The pressure levels within central passage 113 fluctuate with the reciprocating movement of plunger 103. Pressure fluctuations in central passage 113 are equally experienced in outlet tubes 116, the gap between sleeve 105 and plunger 103 (see FIG. 5), and accumulator channel 119

Figure 2:
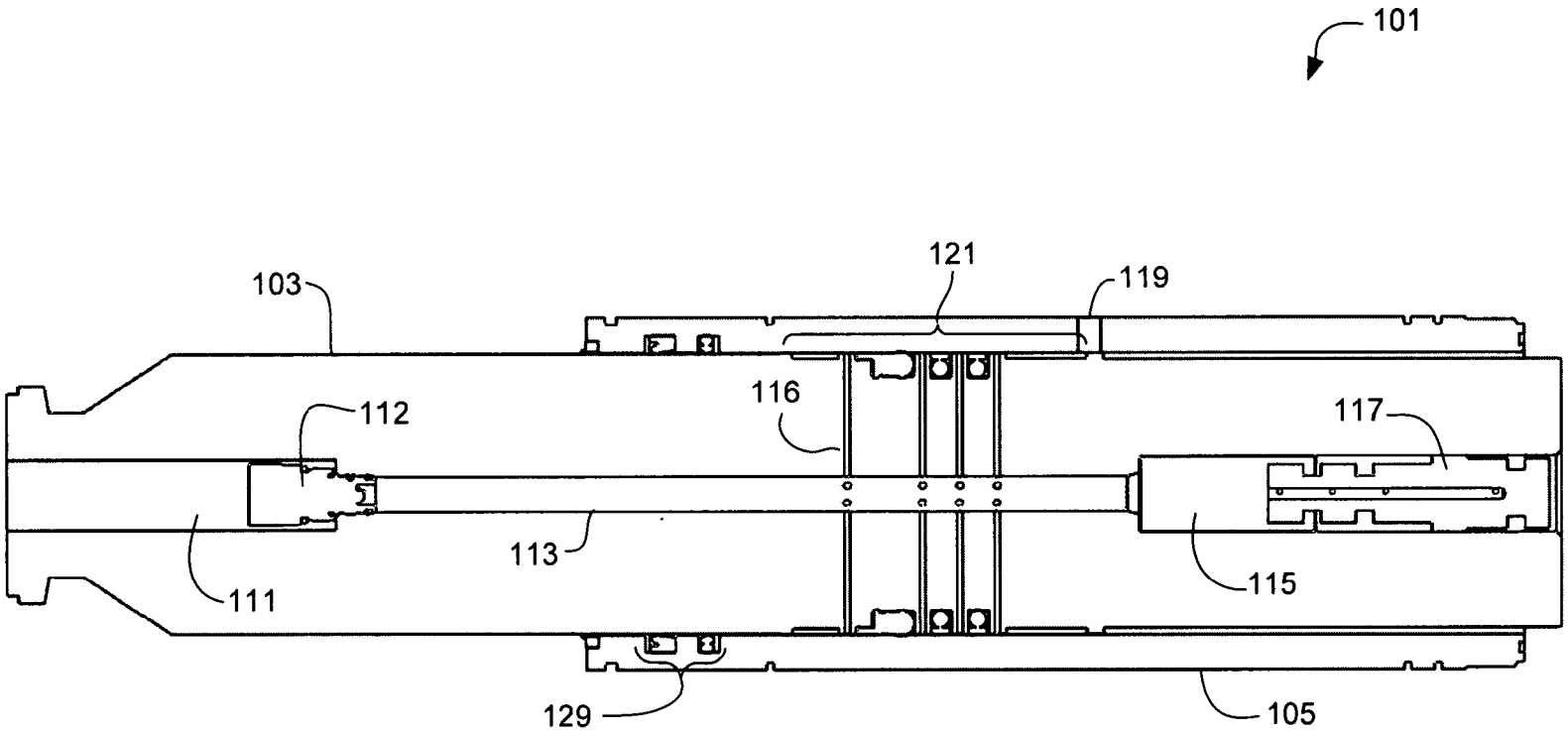
FIGS. 2 and 3 are enlarged section views of the lubricating sealing system pump piston of FIG. 1 shown in alternate positions.
Figure 3:
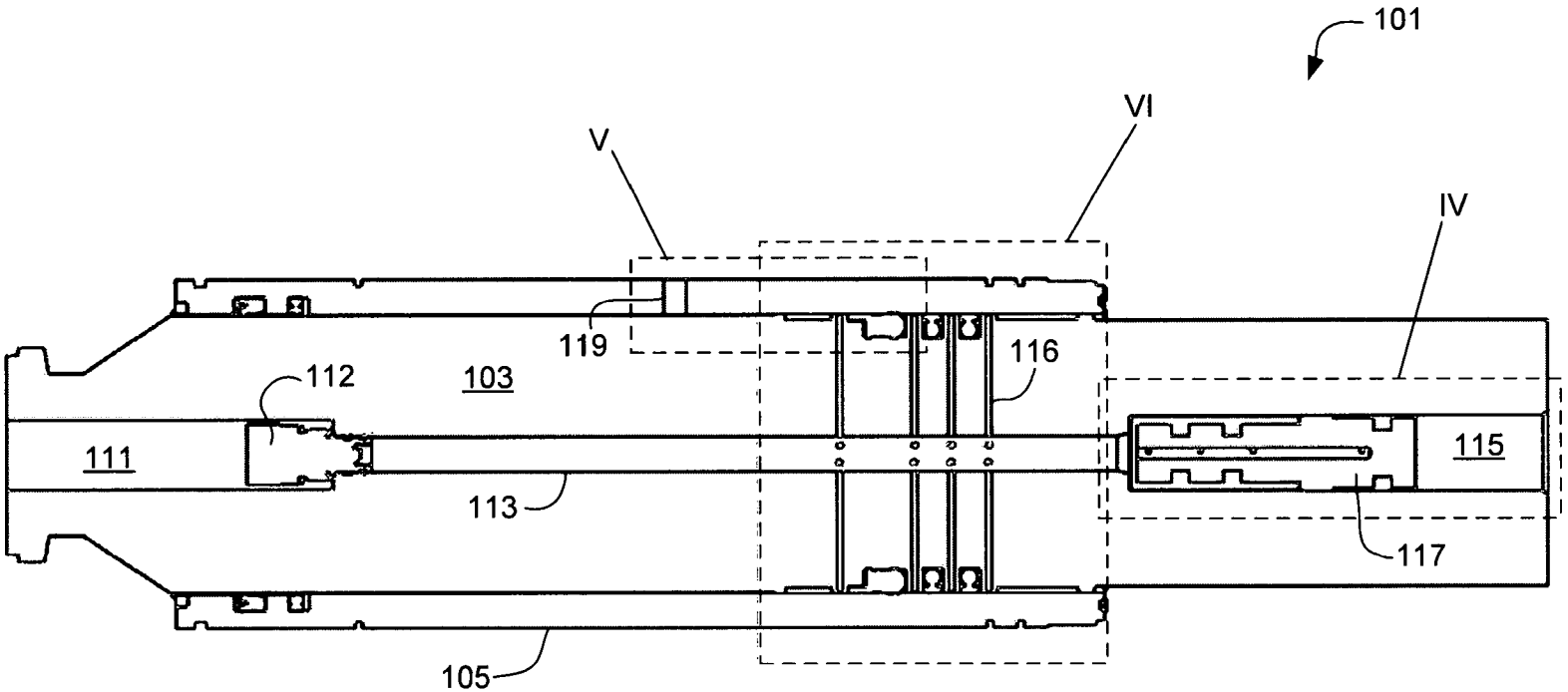

Referring now also to FIGS. 2 and 3 in the drawings, side section views of plunger 103 are shown in relation to sleeve 105 so as to show the movement of plunger 103 and valve 117. As noted previously, plunger 103 operates between a withdrawn position and an extended position. In the withdrawn position, plunger 103 is withdrawn from pressure chamber 104 and plunger 103 extends outward from fluid end 109 at its fullest operable extent. In the extended position, plunger 103 is pushed into pressure chamber 104. FIGS. 2 and 3 show the positions of plunger 103 in relation to sleeve 105. Sleeve 105 is static within fluid end 109.

In FIG. 2, plunger 103 is in the withdrawn position. In this position, plunger 103 exits pressure chamber 104 creating a decrease in pressure within pressure chamber 104, which brings working fluid through suction valve 108 into pressure chamber 104. Pressure chamber 104 is in fluid communication with lower channel 115 and valve 117. Therefore as pressure fluctuates in pressure chamber 104, corresponding pressure fluctuations are felt by and act upon valve 117. These pressure fluctuations reciprocate valve 117 within lower channel 115 and subsequently induce corresponding pressure fluctuations in central passage 113. In this withdrawn position, valve 117 is seen translated within channel 115 adjacent the end of plunger 103 distal to the transition of central passage 113.

In FIG. 3, plunger is in the extended position where plunger 103 is fully inserted into pressure chamber 104. At this time, pressure within pressure chamber 104 is greatest thereby pushing valve 117 within lower channel 115. Valve 117 is adjacent the transition to central passage 113. At this time, movement of valve 117 to this position pressurizes the lubricant within central passage 113 so as to induce movement of the lubricant through outlet tubes 116.

In operation, lubricant is injected or passed through valve 112 into central passage 113 as plunger 103 is in the withdrawn position and valve 117 is adjacent the end of plunger 103. At this time, pressures within central passage 113 are the lowest. Upon the transition of plunger 103 to an extended position, pressure increases in pressure chamber 104 and translates valve 117 to be adjacent central passage 113. Valve 112 is closed and movement of valve 117 pressurizes the lubricant. The subsequent withdrawal of plunger 103 permits for the recharging of lubricant in central passage 113.

Figure 4:
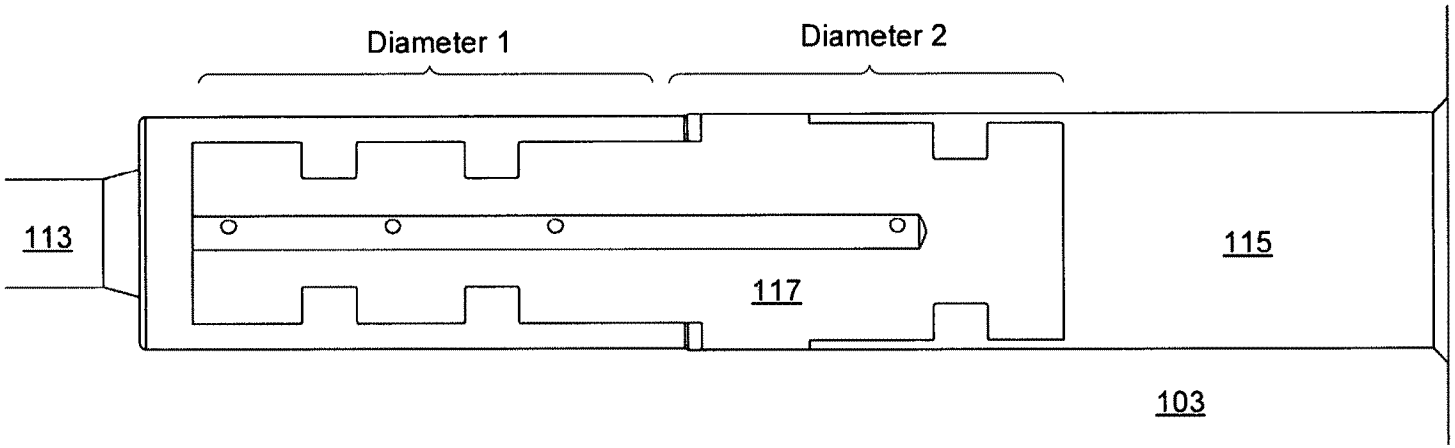
FIG. 4 is an enlarged section view of an intensification valve in the pump piston of FIG. 3.

Referring now also to FIG. 4 in the drawing, an enlarged side section view of intensification valve 117 is illustrated when plunger 103 is in the extended position. Valve 117 includes a plurality of grooves circumferentially oriented about its outer surface for the acceptance of one or more seals (not shown). The seals prevent the passage of proppant from chamber 104 to central passage 113. Valve 117 has two general outer diameters, namely diameter 1 and diameter 2. Diameter 1 is always smaller than diameter 2 causing the lubricant within central passage 113 to be higher than the pressure within pressure chamber 104. This allows for a positive pressure over the seals of plunger 103, between itself and sleeve 105. The positive pressure allows system 101 to flush out particulates over the plunger seals and create a barrier.

Figure 5:
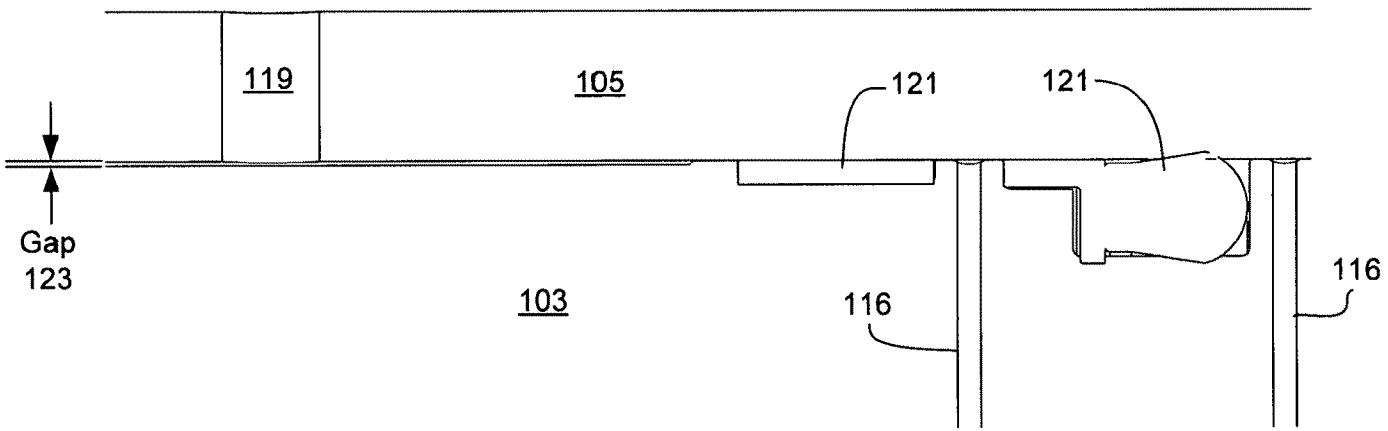
FIG. 5 is an enlarged section view of the lubricating sealing system pump piston of FIG. 3.
Figure 6:
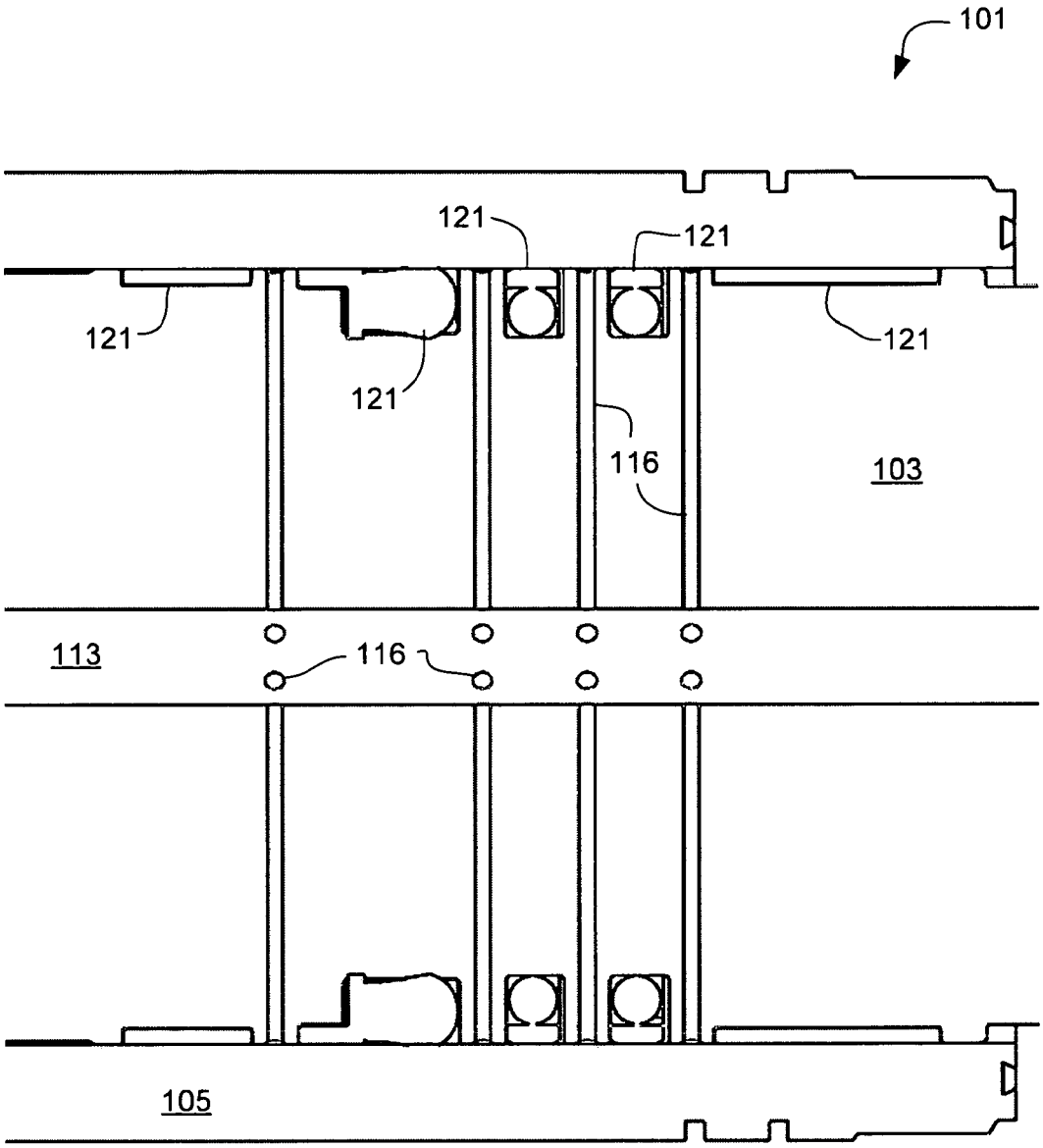
FIG. 6 is an alternate enlarged side and section view of the lubricating sealing system pump piston of FIG. 3.

Referring now also to FIGS. 5 and 6 in the drawings, enlarged side section views of plunger 103 and sleeve 105 is illustrated. Outlet tube 116 are shown in greater detail extending away from central passage 113. Plunger 103 includes a plurality of seals and bearings, collectively named plunger seals 121. Plunger seals are configured to contact and permit reciprocation of plunger 103 relative to sleeve 105 and to prevent the passage of proppant from chamber 104 to a location between plunger 103 and sleeve 105. The introduction of proppant would accelerate wear and lead to premature failure and wash out.

As referenced above, lubricant is recharged with each stroke plunger 103. When pressurized, lubricant exits central passage 113 and passes through outlet tubes 116 where it passes around seals 121. Outlet tubes 116 are dispersed radially around plunger 103 in a perpendicular manner to central passage 113. They are distributed along the length of plunger 113 so as to allow lubricant on either sides of seals 121. Lubricant is passed around seals 121 and also enters into gap 123. Gap 123 is a narrow space between plunger 103 and sleeve 105. Lubricant reaching gap 123 can pass into accumulator channel 119.

Channel 119 passes through sleeve 105 and fluid end 109, extending between gap 123 and accumulator 125. Accumulator 125 is coupled to fluid end 109 across and exterior surface. Accumulator 125 is in fluid communication with accumulator channel 119. Accumulator 125 is configured to include a solenoid valve 127. Valve 127 selectively permits the passage of a quantity of lubricant into accumulator 125. One direction of flow is permitted, that of entering accumulator. Valve 127 is selectively opened during the transition of plunger 103 from the extended position to the withdrawn position. During this time, seals 121 are translated along an inner surface of sleeve 105 toward upper seals 129. Upper seals 129 are coupled to sleeve 105 and located adjacent the outer edge of fluid end 109. Seals 129 contact plunger 103 and prevent the leakage of lubricant. This translation of plunger 103 to the withdrawn position decreases the overall volume within central passage 113, outlet tubes 116, gap 123 and accumulator channel 119. Valve 127 opens to permit lubricant a path to exit so as to prevent lubricant pressures exceeding the capabilities of upper seals 129. Valve 127 closes to prevent the discharge of lubricant back through accumulator channel 119.

Although system 101 has been described as including a collection of parts to induce Particular advantages of the sealing system pump piston 101 have been described. These includes at least the following: 1) the system fits within existing fluid envelopes; 2) no manual adjustment is needed; 3) a robust lubrication of reciprocating sealing components; 4) no fluid end wash out; 5) no maintenance; 6) removes Nano proppant contact with the sealing system; and 6) increased life and reduced costs.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A plunger system for the fluid end of a pump, the plunger system comprising:

an elongated plunger piston having a first end, a second end and an outer surface;

a fluid cavity formed within the elongated plunger piston extending from adjacent the first end to the second end of the plunger piston;

an intensification valve positioned in the fluid cavity adjacent the second end of the piston and movable along a portion of the fluid cavity between a first position and a second position;

a lubrication valve positioned in the fluid cavity adjacent the first end of the piston; and at least one outlet tube extending from the outer surface of the plunger piston to a location along fluid cavity between the intensification valve and the lubrication valve.

2. The plunger system of claim 1, wherein the fluid cavity comprises a central passage, an upper channel in fluid communication with the central passage, and a lower channel in fluid communication with the central passage.

3. The plunger system of claim 1, wherein the fluid cavity is axially aligned within the plunger piston and extends from the first end to the second end of the plunger piston.

4. The plunger system of claim 1, wherein the intensification valve has a first end in fluid communication with the fluid cavity.

5. The plunger system of claim 1, wherein the intensification valve is axially movable in the fluid cavity between the first position and the second position.

6. The plunger system of claim 1, further comprising a bore sleeve at least partially disposed about the plunger piston.

7. The plunger system of claim 1, wherein the plunger piston further comprises a plurality of outlet tubes extending outward from the fluid cavity to the outer surface of the plunger piston.

8. The plunger system of claim 1, further comprising at least one lower seal disposed along the surface of the plunger piston; at least one outlet tube extending to the outer surface of the plunger piston on a first side of the lower seal; and at least one outlet tube extending to the outer surface of the plunger piston on a second side of the lower seal.

9. The plunger system of claim 8, further comprising at least one upper seal adjacent the first end of the plunger piston.

10. The plunger system of claim 9, further comprising at fluid end having a bore formed therein and in which the plunger piston is reciprocating disposed; an accumulator channel extending through a portion of the fluid end and in fluid communication with the surface of the plunger piston between the lower seal and the upper seal; and an accumulator in fluid communication with the accumulator channel.

11. A plunger system for the fluid end of a pump, the plunger system comprising:

an elongated plunger piston having a first end, a second end and an outer surface;

a fluid cavity formed within the elongated plunger piston extending from adjacent the first end to the second end of the plunger piston;

an intensification valve positioned in the fluid cavity adjacent the second end of the piston and movable along a portion of the fluid cavity between a first position and a second position;

at least one outlet tube extending from the outer surface of the plunger piston to a location along fluid cavity between the intensification valve and the lubrication valve; and a lubrication system in fluid communication with the fluid cavity adjacent the first end of the elongated plunger piston.

12. The plunger system of claim 11, wherein the fluid cavity comprises a central passage, an upper channel in fluid communication with the central passage, and a lower channel in fluid communication with the central passage.

13. The plunger system of claim 11, further comprising a lubrication valve disposed in the fluid cavity adjacent the first end of the plunger piston.

14. A method of operating a pump comprising:

reciprocating a plunger piston within a pump between a withdrawn position and an extended position;

introducing lubricant to the surface of the plunger piston by directing the lubricant through an interior passage of the plunger piston.

15. The method of claim 14, further comprising pressurizing the lubricant within the plunger piston upon an extension stroke.

16. The method of claim 14, further comprising translating an intensification valve within the plunger piston during an extension stroke to induce movement of lubricant within the plunger piston outward to the surface of the plunger piston.

17. The method of claim 14, further comprising passing pressurized lubricant over lower seals along the plunger piston during a compression stroke to inhibit ingress of proppant.

18. The method of claim 14, further comprising utilizing fluid pressure within the pump to translate an intensification valve between a first position and a second position within the plunger piston in order to induce pressurization of the lubricant within a cavity of the plunger piston.

19. A method for operating a pump comprising:

reciprocating a plunger piston within a pump between a withdrawn position and an extended position;

during the stroke from the extended position to the withdrawn position, injecting a lubricant into an interior cavity of the plunger piston; and during the stroke from the withdrawn position to the extended position, driving the injected lubricant radially outward from the interior cavity to the outer surface of the plunger piston.

20. The method of claim 19, further comprising utilizing fluid pressure within the pump to translate an intensification valve between a first position and a second position within the plunger piston in order to induce pressurization of the lubricant within a cavity of the plunger piston, thereby inducing movement of lubricant within the plunger piston outward from the cavity to the surface of the plunger piston; and recharging lubricant into the interior passage of the plunger piston with each stroke of the plunger piston from an extended position to a withdrawn position.

21. The method of claim 20, further comprising utilizing the pressurized lubricant to activate upper seals along the plunger piston during a compression stroke; and passing pressurized lubricant over lower seals along the plunger piston during a compression stroke to inhibit ingress of proppant.

22. The method of claim 21, further comprising determining pressure limits for the upper seals about the plunger piston and regulating lubricant pressure at the surface of the plunger piston based on the determined pressure, wherein regulating comprises utilizing an accumulator to receive a quantity of excess pressurized lubricant adjacent the surface of the plunger piston.

* * * * *